US005201425A

United States Patent [19]

Roux et al.

[11] Patent Number: 5,201,425

[45] Date of Patent: Apr. 13, 1993

[54] SHEET TRAY WITH AN ENERGY ABSORBING BACKSTOP AND SCUFFER MECHANISM

[75] Inventors: Mary A. Roux; Thomas W. Rathbun; Stephen A. Demchock, all of Rochester, N.Y.

[73] Assignee: Xerox Corporation, Stamford, Conn.

[21] Appl. No.: 840,201

[22] Filed: Feb. 24, 1992

[51] Int. Cl.[5] ..... B65H 31/36

[52] U.S. Cl. ..... 271/3.1; 271/224; 271/236

[58] Field of Search ..... 271/3.1, 163, 220, 221, 271/224, 236

[56] References Cited

U.S. PATENT DOCUMENTS

| | | | |
|---|---|---|---|
| 2,761,682 | 9/1956 | Buccicone | 271/224 |
| 2,821,391 | 1/1958 | Buccicone | 271/224 |
| 4,330,197 | 5/1982 | Smith et al. | 271/3.1 |
| 4,380,332 | 4/1983 | Davis | 271/224 |
| 4,778,170 | 10/1988 | Hynes | 271/253 |
| 4,883,265 | 11/1989 | Iida et al. | 271/220 |
| 5,022,640 | 6/1991 | Greco, Jr. | 271/3.1 |
| 5,116,036 | 5/1992 | LeRoy et al. | 271/3.1 |

FOREIGN PATENT DOCUMENTS

| | | | |
|---|---|---|---|
| 648541 | 9/1962 | Canada | 271/224 |
| 64470 | 4/1984 | Japan | 271/224 |
| 134465 | 6/1988 | Japan | 271/224 |

*Primary Examiner*—Robert P. Olszewski
*Assistant Examiner*—Steven M. Reiss
*Attorney, Agent, or Firm*—H. Fleischer; J. E. Beck; R. Zibelli

[57] ABSTRACT

An electrophotographic printing machine of the type having a duplex tray for collecting sheets having an image formed on one side thereof. Successive sheets collected in the duplex tray are advanced therefrom to the processing stations of the printing machine to have an image formed on the other side thereof. The duplex tray has at least one backstop member positioned thereon and adapted to engage an edge of the sheets being collected. The backstop member stops movement of the sheets and is adapted to deflect upon being contacted by the sheet edge. When the leading edge of the sheet engages the backstop member, the backstop member deflects and absorbs energy. This also increases the sheets contact area and minimizes denting and deletions of the image edge of the sheet edge contacting the backstop member.

8 Claims, 4 Drawing Sheets

SHEET TRAY WITH AN ENERGY ABSORBING BACKSTOP AND SCUFFER MECHANISM

This invention relates generally to a printing machine, and more particularly concerns a duplex tray having an energy absorbing backstop and scuffer mechanism.

High speed electrophotographic printing machines are capable of performing both simplex copying and duplex copying. In simplex copying, an image is formed on only one side of the sheet. In contradistinction, in duplex copying, the image is formed on both sides of the sheet. Generally, an electrostatic latent image is recorded on a photoconductive member and developed with toner particles. The toner particles are subsequently transferred to the sheet and fused thereto. The sheet having toner particles fused to one surface thereof, then advances to the duplex tray. Thereafter, the sheet is fed from the duplex tray back to the transfer station to enable another toner image to be transferred to the other side of the sheet. This second toner powder image is then fused to the sheet with the sheet there being advanced from the printing machine. In this way, a duplex copy is formed.

The duplex tray is arranged to receive sheets having a first side copied thereon. A scuffer assembly is located on the duplex tray and includes rotating rollers which engage the lead edge of the sheets and drive the sheets into edge registration thereby effecting corner registration of the sheets as they become deposited into the tray. The scuffer assembly is movable to adjust for different size sheets. It has been found that the edges of the sheets are dented when they contact the solid scuffer rollers in the duplex tray. These dents cause deletions on the edges of the duplexed copy in the areas where the sheet contacts the scuffer rollers. The following disclosures may be relevant to various aspects of the present invention:

U.S. Pat. No. 4,778,170. Patentee: Hynes. Issued: Oct. 18, 1988.

U.S. Pat. No. 4,883,265. Patentee: Iida, et al. Issued: Nov. 28, 1989.

The disclosures of the above-identified patents may be briefly summarized as follows:

U.S. Pat. No. 4,778,170 discloses a scuffer/backstop mechanism for a duplex copy sheet tray. The scuffer/backstop mechanism includes a pair of spaced rotating rollers which serve as stops for the sheets entering the duplex tray. The rollers rotate to drive the sheets against side registration elements effecting corner registration.

U.S. Pat. No. 4,883,265 describes a tray apparatus having a sheet aligning member in the form of an endless web which contacts the top surface of the sheet which has been discharged onto a tray. The web displaces the sheet in a direction opposed to the direction of advancement until the trailing edge of the sheet abuts a stopper member located adjacent that end of the tray near the discharging outlet.

In accordance with one aspect of the present invention, there is provided an apparatus for collecting sheets having an image formed on one side thereof and for forwarding sheets therefrom. The apparatus includes a tray for collecting the sheets. At least one backstop member is positioned on the tray to engage an edge of the sheets being collected thereon and arrest movement thereof. The backstop member is adapted to deflect upon being contacted by the sheet edge absorbing energy and increasing the sheet contact area to minimize denting and deletions of the image edge of the sheet edge contacting the backstop member.

Pursuant to another aspect of the present invention, there is provided an electrophotographic printing machine of the type having a duplex tray for collecting sheets having an image formed on one side thereof. Means advance successive sheets collected on the duplex tray therefrom for forming an image on the other side thereof. The improvement includes at least one backstop member positioned on the duplex tray to engage an edge of the sheets being collected thereon and arrest movement thereof. The backstop member is adapted to deflect upon being contacted by the sheet edge absorbing energy and increasing sheet contact area to minimize denting and deletions of the image edge of the sheet edge contacting the backstop member.

Other aspects of the present invention will become apparent as the following description proceeds and upon reference to the drawings in which.

While the present invention will hereinafter be described in connection with various embodiments thereof, it will be understood that it is not intended to limit the invention to these embodiments. On the contrary, it is intended to cover all alternatives, modifications and equivalents as may be included within the spirit and scope of the invention as defined by the appended claims.

Figure 1:
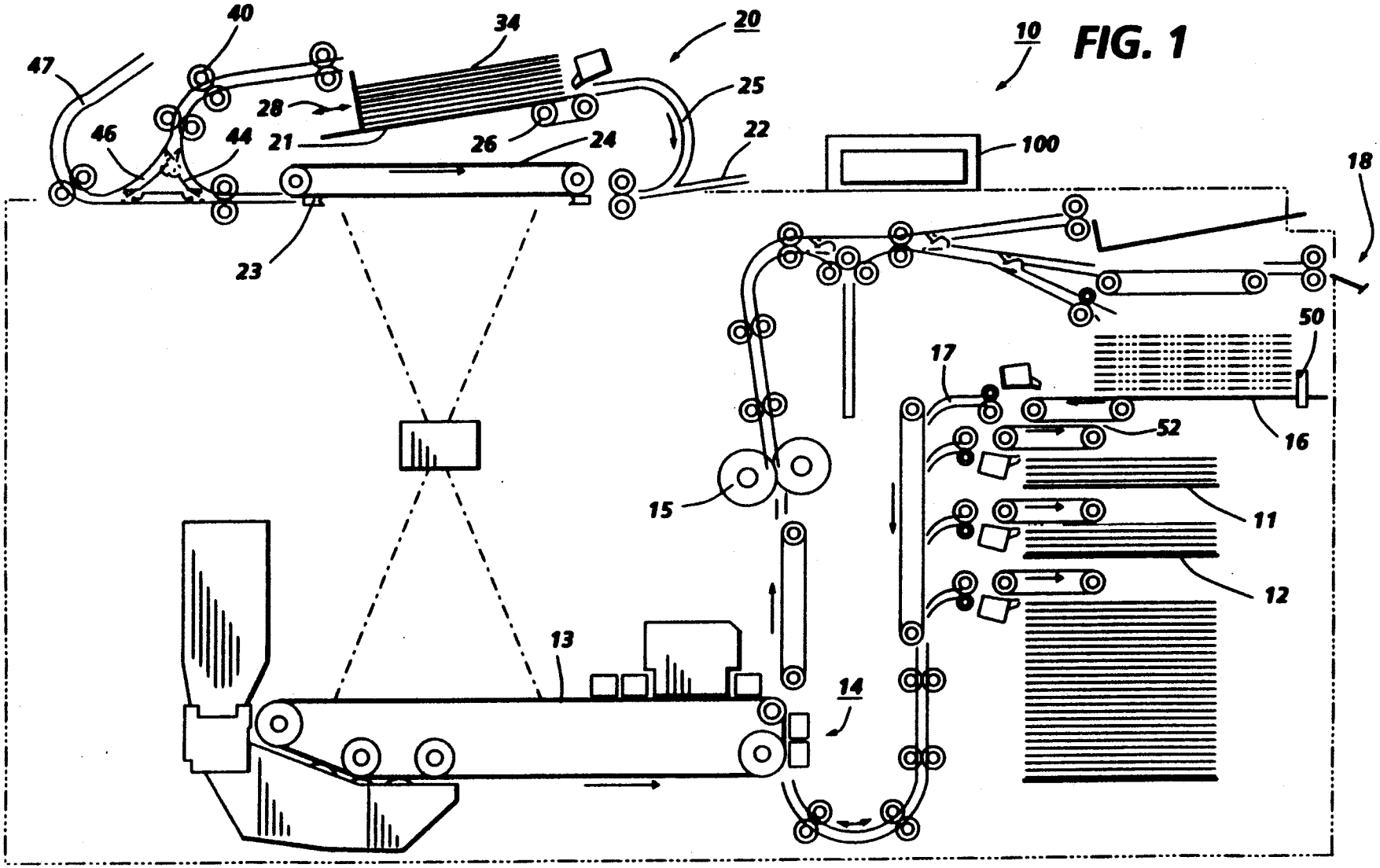
FIG. 1 is a schematic, elevational view depicting an illustrative electrophotographic printing machine incorporating the features of the present invention therein.

For a general understanding of the features of the present invention, reference is made to the drawings. In the drawings, like reference numerals have been used throughout to designate identical elements. FIG. 1 schematically depicts an electrophotographic printing machine incorporating features of the present invention therein. It will become evident from the following discussion that the features of the present invention are not specifically limited in their application to the particular printing machine depicted herein, but may be used in any suitable printing machine wherein a tray having a scuffer mechanism is employed.

Referring now to FIG. 1 of the drawings, the printing machine and its operation will be described with reference thereto. Inasmuch as the art of electrophotographic printing is well known, the operation of the printing machine will be described briefly hereinafter.

The electrophotographic printing machine, generally designated by the reference numeral 10, is shown reproducing copies of original documents advanced by a document feeder, indicated generally by the referenced numeral 20. Document feeder 20 is shown positioned above a platen at the imaging station of printing machine 10. Document feeder 20 provides for automatically feeding or transporting individually registered and spaced documents onto and over the platen 23 of copier 10. Document feeder 20 has the conventional "racetrack" document loop path configuration, and preferably has generally known inverting and non-inverting return circulation paths to loading and restacking tray 21. Documents may be fed to platen 23 to be copied by the same platen transport belt 24 from either the loading side slot 22 at one side of the document feeder 20, or from the loading or stacking tray 21. The regular document feeding input is from the bottom of the stacking tray 21 through an arcuate, inverting, input path 25 to the upstream end of the platen transport 24. This input path 25 preferably includes a known stack bottom corrugating feeder-separator belt and and air knife system 26, and a first set of turn baffles and feed rollers to naturally invert the documents once before copying.

After the documents are copied on platen 23, they may be ejected by the platen transport system 24 into a downstream or off-platen rollers and fed passed a gate or gates and sensors. Depending upon the position of these gates, they either guide the documents directly to a document output path to a catch tray, or more commonly, the documents are deflected into a return path 40 taking them back to tray 21 to restack on top of the documents then in tray 21. In this way, the document set can be continuously refed and recirculated. Return path 40 includes reversible rollers to provide a choice of two different return paths to tray 21; a simplex return path 44 with one inversion, or a reversible duplex return path 46 without an inversion. The duplex return path 46 provides a desired inversion of duplex documents in one circulation. In normal operation, a duplex document has only one inversion per circulation. In contrast, in the simplex circulation path there are two inversions per circulation, one in each of the paths.

With continued reference to FIG. 1, electrophotographic printing machine 10 includes a belt 13 having a photoconductive surface deposited on a conductive substrate. The belt advances successive portions of the photoconductive surface to various processing stations disposed about the path of movement thereof. At the charging station, a corona generating device charges the photoconductive surface of the belt to a relatively, high, substantially uniform potential. Thereafter, the charged portion of the photoconductive surface is advanced through the imaging station. At the imaging station, a flash lamp illuminates the original document on platen 23. The light rays reflected from the original document are transmitted through the lens forming a light image thereof. These light rays are focused onto the charged portion of the photoconductive surface to selectively dissipate the charge thereon. This records an electrostatic latent image on the photoconductive surface which corresponds to the informational areas contained within the original document disposed upon the platen. After the electrostatic latent image is recorded on the photoconductive surface, the belt advances it through a development station. At the development station, a magnetic brush development system transports a developer material of carrier granules and toner particles into contact with the electrostatic latent image recorded on the photoconductive surface. The toner particles are attracted from the carrier granules to the electrostatic latent image forming a developed image or a toner powder image on the photoconductive surface of the belt.

After development, the belt advances the developed image to the transfer station. At the transfer station, a copy sheet is moved into contact with the toner powder image. A corona generating device sprays ions onto the backside of the copy sheet. This attracts the toner powder image from the photoconductive surface to the copy sheet. After transfer, the copy sheet moves to the fusing station. The fusing station includes a fuser assembly which permanently affixes the transferred toner powder image to the copy sheet. By way of example, the fuser assembly includes a heated fuser roll and backup roll. The copy sheet passes between the fuser roll and back-up roll with the toner powder image contacting the fuser roll. In this manner, the toner powder image is permanently affixed to the copy sheet. After fusing, a conveyor belt guides the advancing sheet to a catch tray or to a finishing station wherein a plurality of sets may be formed with the copy sheets being either stapled or bound to one another.

Blank or clean copy sheets can be conventionally fed from trays 11 or 12, or the high capacity feeder input thereunder, to transfer station 14 to have the toner powder image transferred thereto. The transferred toner powder image is fused to the copy sheet by fuser 15. A duplex tray 16 collects and temporarily stacks documents therein which are being duplexed. Duplex tray 16 has a backstop 50 thereon. Backstop 50 arrests the movement of the sheet being advanced onto duplexed tray 16 and provides registration therefor by moving it into a corner registration guide. Further details of duplex tray 16 and backstop 50 will be discussed hereinafter with reference to FIGS. 2 through 6, inclusive. A sheet feeder 52 advances the stacked sheets from duplex tray 16 by a path 17 to transfer station 14. At transfer station 14, the sheet receives an image on the second side thereof in the same manner as the image was deposited on the first side thereof. The completed duplex copy exits to a finishing and stacking module via output path 18.

All printing machine document feeder and finishing operations are preferably controlled by a programmable controller 100. As suitable known programmable microprocessor system is described in U.S. Pat. No. 4,475,156, the relevant portion thereof being hereby incorporated into the present application. The controller 100 controls all of the machine functions described herein including all sheet feeding. A known touch screen type of operator input control and display is utilized in conjunction with controller 100.

Figure 2:
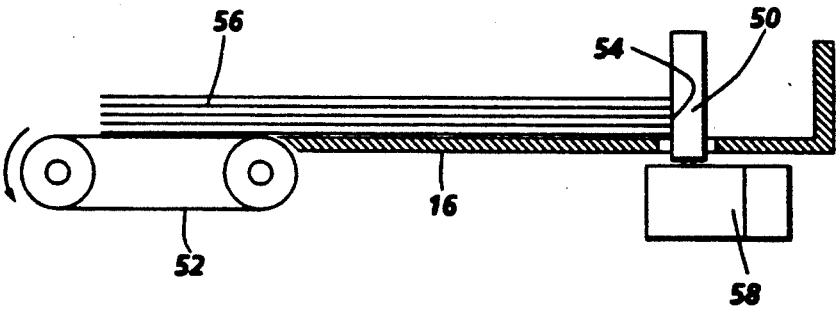
FIG. 2 is a schematic, elevational view of a duplex tray used in the FIG. 1 printing machine and having the scuffer roll mechanism of the present invention incorporated therein.

Turning now to FIG. 2, there is shown further details of duplex tray 16. Duplex tray 16 includes an adjustable copy sheet scuffer or backstop mechanism 50 for engaging the leading edge 54 of the copy sheets 56 to be duplexed as the copy sheets are fed into duplex tray 16 when the printing machine is programmed to produce duplex or two-sided copies. The backstop rollers 50 are movable toward and away from the bottom feeder 52 in order to position the leading edges of copy sheets in the trays so that they may be properly fed out of the tray by feeder 52 during the duplex operation. The movement of the backstop rollers is sufficient to accommodate the various types of sheet widths that may be usable in the printing machine.

As shown in FIG. 2, a plurality of copy sheets 52 are positioned in tray 16 with their rear edges 54 against rollers 50. In entering the tray, what was once the leading edges of the sheets are now the trailing edges and what was the trailing edges are now the leading edges. A motor and pulley assembly 58 drives rollers 50. Thus, rollers 50 are rotated about their longitudinal axes. Rollers 50 are positioned so that their longitudinal axes are substantially perpendicular to tray 16 and to the stack of sheets 56.

Figure 3:
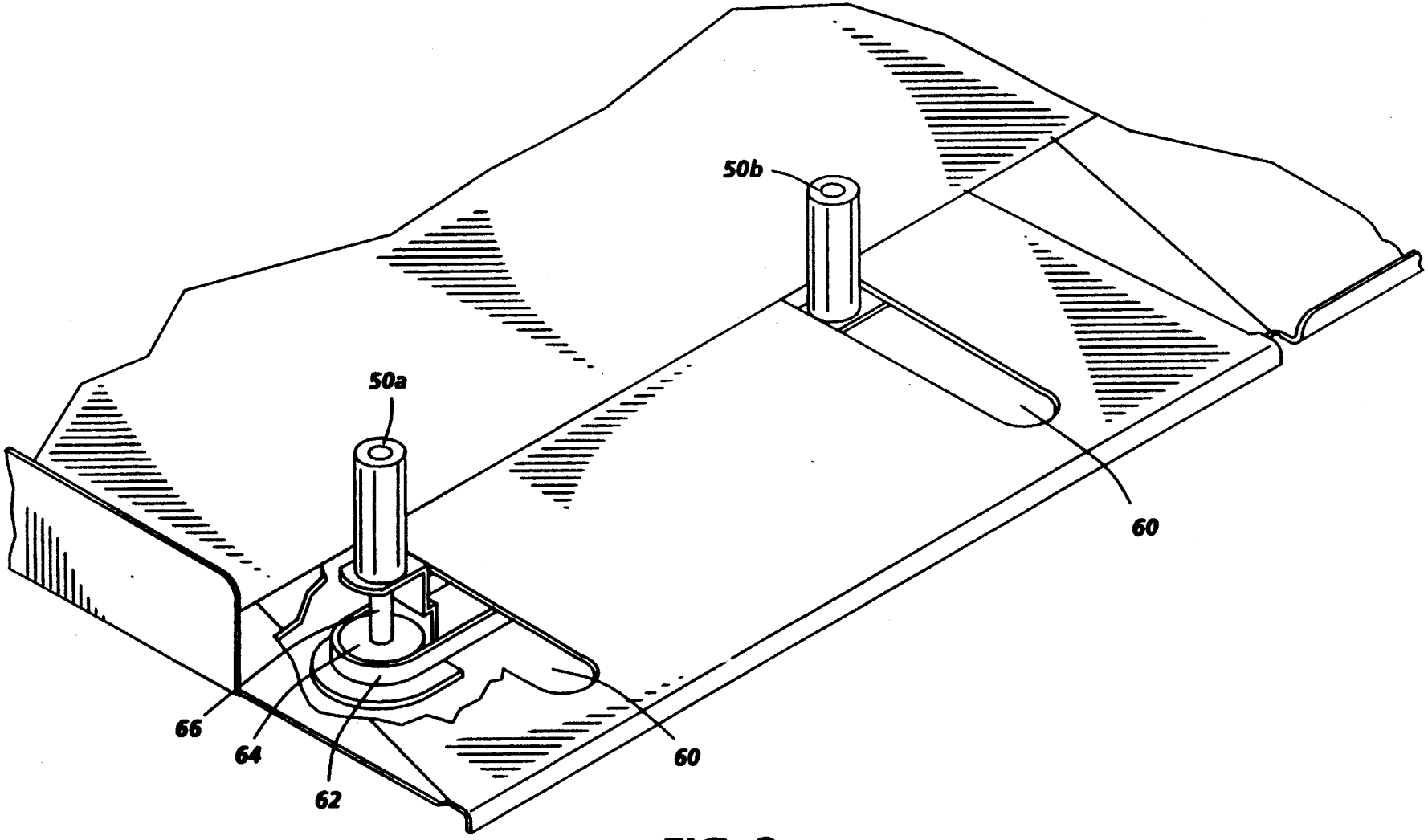
FIG. 3 is a fragmentary, perspective view of the duplex tray and scuffer rollers used in the FIG. 2 duplex tray.

Referring now to FIG. 3, there is shown duplex tray 16 with cutouts 60 therein. These cutouts or slots permit rollers 50*a* and rollers 50*b* to extend in a direction substantially perpendicular to the planar surface of tray 16 while still being movable relative to the edge of stack 54 so as to be adjustable for different size sheets. Rollers 50*a* and 50*b* are driven by a motor 58 coupled to belt 62. Drive belt 62 is entrained about a pulley 64 which rotates a shaft 66 having rollers 50*a* and 50*b* mounted respectively thereon.

Figure 4:
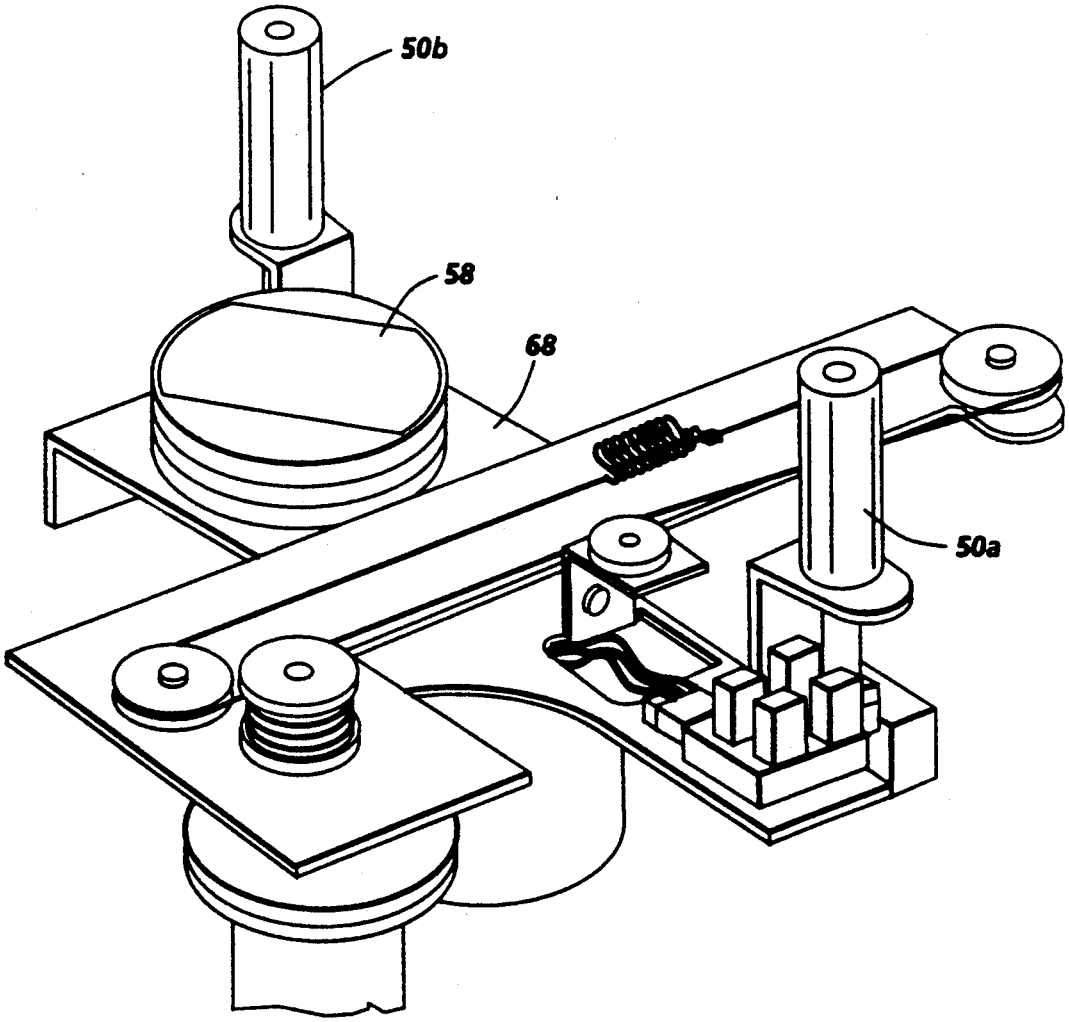
FIG. 4 is a perspective view showing the scuffer rollers with their drive mechanism.

Referring now to FIG. 4, there is shown the motor and backstop rollers in greater detail. Backstop rollers 50*a* and 50*b* are spaced from one another and driven by a belt pulley system coupled to motor 58. With this arrangement, the longitudinal axis of rollers 50*a* and 50*b* are parallel to each other and to the rear side of tray 16. Motor 58 is mounted upon the upper side of plate 68. Timing belt 62 is arranged to impart rotation to rollers 50*a* and 50*b* in the same direction counter clockwise to thereby force or scuff each sheet of paper entering the tray against side registration stops mounted on the side edge of the bottom plate of duplex tray 16. By this arrangement, the scuffer mechanism is adapted to register sheets in the forward direction and also to produce side registration so that copy sheets leaving the duplex tray for the duplex operation are properly corner registered as they leave the tray.

Figure 5:
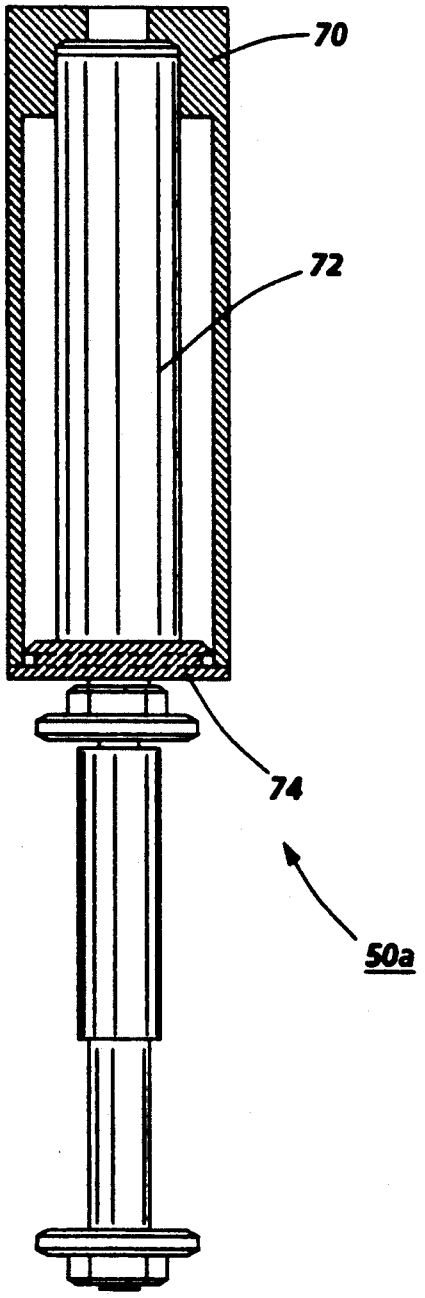
FIG. 5 is one embodiment of the scuffer roller.

Referring now to FIG. 5, there is shown one embodiment of backstop rolls 50. Both backstop rolls 50*a* and 50*b* are substantially identical to one another and only one of them will be described hereinafter i.e. backstop roll 50*a*. As shown in FIG. 5, backstop roll 50*a* includes a sleeve 70 made preferably from an elastomeric material. Sleeve or tubular member 70 is substantially hollow. A drive shaft 72 is mounted interiorly of sleeve 70 and spaced from the interior walls thereof. Sleeve 70 is press fit onto drive shaft 72 at one end. There is a hole in one end of sleeve 70 to permit air to escape during the press fit assembly. Sleeve 70 is open ended at the other end to permit drive shaft 72 to be mounted therein. A bottom cap 74 is press fit into sleeve 70 and locates the sleeve concentrically relative to drive shaft 72 by means of a tight tolerance fit with drive shaft 72. Drive shaft 72 extends outwardly from the bottom cap of sleeve 70 and is mounted on a pulley to be driven by timing belt 62 coupled to motor 58.

Figure 6:
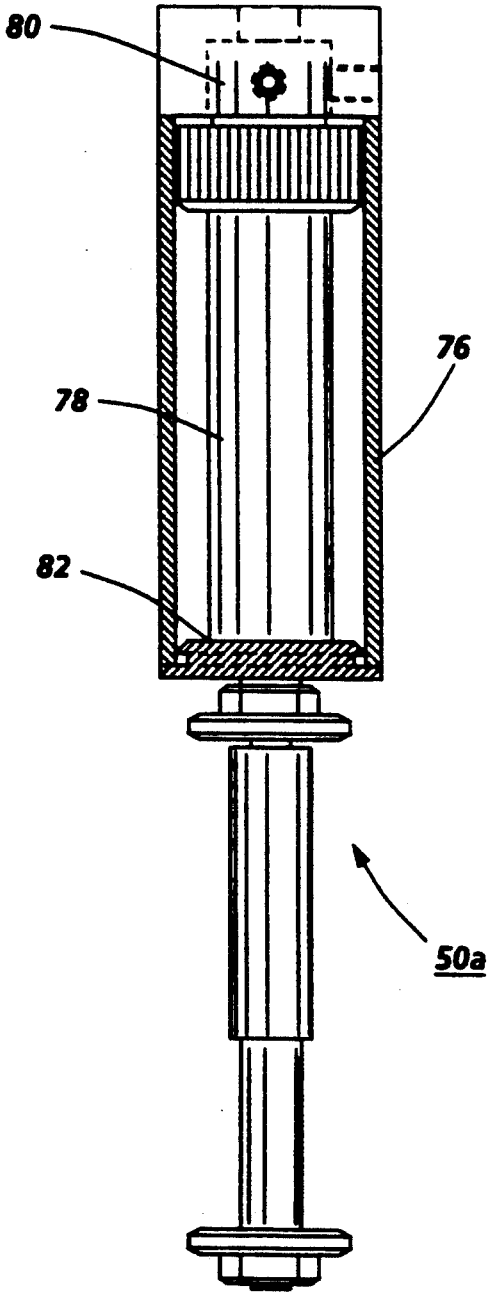
FIG. 6 is another embodiment of the scuffer roller.

Another embodiment of backstop roll 50*a* is depicted in FIG. 6 as shown thereat, backstop roll 50*a* includes a tube 76 having both ends opened. A drive shaft 78 is mounted interiorly of tube 76 and extends outwardly therefrom at one end. Top cap 80 receives one end of shaft 78 and encloses and secures that end of tube 76. Bottom cap 82 secures the other end of tube 76 while permitting shaft 78 to pass therethrough and extend outwardly therefrom. The outwardly extending portion of shaft 78 has a pulley mounted thereon with timing belt 62 wrapped thereabout so as to be driven by motor 58.

It is clear that the backstop rollers depicted in FIGS. 5 and 6 are hollow. The wall thickness is designed to be relatively thin and preferably made of an elastomeric material so as to permit the roll sleeve or tube to deflect when the leading edge of the sheet engages it. Thus, the leading edge of the sheet engages the sleeve or tube of the backstop roller. The wall thereof deflects absorbing energy. This also increases the contact area of the sheet with the roll. As the contact roll increases, the stress on the leading edge of the sheet is reduced. Thus, by absorbing energy due to deflection of the walls of the backstop rollers and increasing the contact area with the leading edge of the sheet, the leading edge of the sheet does not dent and cause deletions on the copy.

By way of example, the embodiment shown in FIG. 5 has the inner diameter of sleeve 70 reduced to enable the drive shaft 72 to be press fit therein. This feature can be molded into the part. The bottom cap has a center hole with a tight clearance fit to the drive shaft and a sharp edged outer diameter that the sleeve is press fit over.

By way of example, the embodiment depicted in FIG. 6 consists of a hollow tube with a top and bottom cap. The top cap has a narrow diameter that the sleeve is press fit over. A set screw attaches the drive shaft to the tube. The bottom cap is essentially identical to that of the FIG. 5 and has a center hold, with a tight clearance fit to the drive shaft and a sharp edged outer diameter that the tube is press fit over.

In recapitulation, it is clear that the duplex tray of the present invention has a backstop roller positioned therein to engage an edge of the sheets being collected. The backstop roller arrests movement of the sheets and deflects upon being contacted by the sheet edge. In this way, the backstop roller absorbs energy and increases the sheet contact area so as to minimize denting and image delation of the sheet edge during contact.

It is, therefore, evident that there has been provided in accordance with the present invention a duplex tray having backstop rollers that fully satisfy the aims and advantages hereinbefore set forth. While this invention has been described in conjunction with specific embodiments thereof, it is evident that many alternatives, modifications and variations will be apparent to those skilled in the art. Accordingly, it is intended to embrace such alternatives, modifications and variations that fall within the spirit and broad scope of the claims.

We claim:

1. An apparatus for collecting sheets having an image formed on one side thereof and for forwarding sheets therefrom, including:

a tray for collecting the sheets; and a roll mounted on said tray with the longitudinal axis thereof substantially perpendicular to said tray, said tray including a sheet discharge outlet with said roll being locating in the marginal region of said tray opposed from said sheet discharge outlet, said roll being positioned on said tray to engage an edge of the sheets being collected thereon and to arrest movement thereof, said roll being adapted to deflect upon being contacted by the sheet edge so as to absorb energy, thereby increasing the contact area with the edge of the sheet so as to minimize denting of the sheet and deletions of the edge of the image on the sheet, said roll includes a rotating tubular member adapted to deflect upon being contacted by the sheet edge.

2. An apparatus according to claim 1, further including a second backstop member spaced from said first mentioned backstop member and positioned in the marginal region of said tray opposed from said sheet discharging outlet.

3. An apparatus according to claim 2, wherein said second backstop member includes a second roll.

4. An apparatus according to claim 3, wherein said second roll includes a second rotating tubular member adapted to deflect upon being contacted by the sheet edge.

5. An electrophotographic printing machine of the type having a duplex tray for collecting sheets having an image formed on one side thereof and means for advancing successive sheets collected on said duplex tray therefrom for forming an image on the other side thereof, wherein the improvement includes:

a roll mounted on the tray with the longitudinal axis thereof substantially perpendicular to the tray, the tray having a sheet discharge outlet with said roll being located in the marginal region of the tray opposed from the sheet discharging outlet, said roll being adapted to an engage an edge of the sheets being collected thereon and arrest movement thereof, said roll being adapted to deflect upon being contacted by the sheet edge so as to absorb energy, thereby increasing the contact area with the edge of the sheet and said roll so as to minimize denting of the sheet and deletions of the edge of the image on the sheet, said roll includes a rotating tubular member adapted to deflect upon being contacted by the sheet edge.

6. A printing machine according to claim 5, further including a second backstop member spaced from said first mentioned backstop member and positioned in the marginal region of said tray opposed from said sheet discharging outlet.

7. A printing machine according to claim 6, wherein said second backstop member includes a second roll.

8. A printing machine according to claim 7, wherein said second roll includes a second rotating tubular member adapted to deflect upon being contacted by the sheet edge.

* * * * *